United States Patent [19]

Kondo et al.

[11] 4,395,474

[45] Jul. 26, 1983

[54] ELECTROPHOTOGRAPHIC PHOTOSENSITIVE MEMBER WITH CURED CYCLIZED RUBBER BINDER

[75] Inventors: Hideyo Kondo, Toride; Naoto Fujimura, Abiko, both of Japan

[73] Assignee: Canon Kabushiki Kaisha, Tokyo, Japan

[21] Appl. No.: 199,531

[22] Filed: Oct. 22, 1980

Related U.S. Application Data

[63] Continuation of Ser. No. 950,728, Oct. 12, 1978, abandoned.

[30] Foreign Application Priority Data

Oct. 15, 1977 [JP] Japan ..... 52-123683

[51] Int. Cl.[3] ..... G03G 5/087

[52] U.S. Cl. ..... 430/67; 430/96

[58] Field of Search ..... 430/67, 96

[56] References Cited

U.S. PATENT DOCUMENTS

| | | | |
|---|---|---|---|
| 3,121,006 | 2/1964 | Middleton et al. | 430/96 X |
| 3,245,786 | 4/1966 | Cassiers et al. | 430/96 X |
| 3,653,064 | 3/1972 | Inoue et al. | 430/96 X |
| 3,928,036 | 12/1975 | Jones | 430/96 X |

FOREIGN PATENT DOCUMENTS

| | | |
|---|---|---|
| 498235 | 10/1972 | Japan . |
| 50-31828 | 10/1975 | Japan . |
| 1443004 | 7/1976 | United Kingdom . |

OTHER PUBLICATIONS

Harita et al., "New Photoresists of Cyclized Butadiene Polymers", Poly. Engr. & Sci., vol. 17, No. 6, Jun. 1977, 4 pp.

*Primary Examiner*—Roland E. Martin, Jr.

*Attorney, Agent, or Firm*—Fitzpatrick, Cella, Harper & Scinto

[57] ABSTRACT

In an electrophotographic photosensitive member having a photoconductive layer composed of a photoconductive material and a binder, improvement wherein said binder is a curable rubber.

2 Claims, No Drawings

ELECTROPHOTOGRAPHIC PHOTOSENSITIVE MEMBER WITH CURED CYCLIZED RUBBER BINDER

This is a continuation, division of application Ser. No. 950,728, filed Oct. 12, 1978 now abandoned.

BACKGROUND OF THE INVENTION

1. Field of the Invention

This invention relates to a photosensitive member for use in electrophotography.

2. Description of the Prior Art

The electrophotographic photosensitive member takes various constructions for obtaining a predetermined characteristics or in accordance with the kind of the electrophotographic processes to be applied. Representative photosensitive member for the electrophotography is such one that is provided with a photoconductive layer on a substrate or such one that is provided with an insulating layer on the surface of the photoconductive layer, both types being used widely. The photosensitive member consisting of the substrate and the photoconductive layer is used for image formation by the most common electrophotographic processes including electric charging, image exposure, image development, and, depending on necessity, image transfer. As to the photosensitive member having the insulative layer thereon, such insulative layer is provided for the purposes of protecting the photoconductive layer, improving the mechanical strength of the photosensitive member, improving the dark decay characteristic, or being applied to a particular electrophotographic process, or further preventing pollutions. Representative examples of the photosensitive member having such insulative layer and the electrophotographic process using the photosensitive body having such insulative layer thereon are disclosed, for example, in U.S. Pat. No. 2,860,048, Japanese patent publications Nos. 16429/1966, 15446/1963, 3713/1971, 23910/1967, 24748/1968, 19747/1967, 4121/1961, and so on.

The electrophotographic photosensitive member is liable to be damaged inasmuch as it is subjected to various electrical and mechanical impacts such as corona charging process, image developing process, cleaning process, and so forth. It is also liable to lower its charge sustaining capability on account of moisture. Therefore, when the electrophotographic photosensitive member undergoes such damages time and again, the quality of the image to be formed thereon becomes remarkably deteriorated. In particular, when the photoconductive layer is composed of a binder and a photoconductive material (various resins being used as the binder), its durability is also poor. Also, the image to be formed on the electrophotographic photosensitive member is poorer in its tonality than the image formed by use of ordinary photographic emulsion.

In the photosensitive member having the insulative layer, when the layer is formed on the photoconductive layer, it becomes necessary for the photosensitive member to be excellent in its durability so that the insulative layer of a desired mechanical strength may be formed thereon without disturbing the composition of the photoconductive layer. For this purpose, when the insulative layer is formed by, for example, application of a liquid resin, the photoconductive layer should not be of such quality that is dissolved in the solvent of the liquid resin.

In view of the foregoing, there has so far been strong demands for the electrophotographic photosensitive member excellent in durability against electrical and mechanical impacts, moisture resistance, tonality, and so forth. However, it has been difficult to provide such electrophotographic photosensitive member excellent in these various characteristics.

SUMMARY OF THE INVENTION

It is therefore an object of the present invention to provide an electrophotographic photosensitive member excellent in its electrical and mechanical durability.

It is another object of the present invention to provide an electrophotographic photosensitive member excellent in moisture resistance.

It is still another object of the present invention to provide an electrophotographic photosensitive member excellent in tonality.

It is other object of the present invention to provide an electrophotographic photosensitive member which causes the least memory phenomenon, hence no ghost image.

It is still other object of the present invention to provide an electrophotographic photosensitive member excellent in its toner transfer efficiency.

The electrophotographic photosensitive member according to the present invention is characterised in that it has a photoconductive layer composed of a curable rubber as a binder and a photoconductive material.

DESCRIPTION OF THE PREFERRED EMBODIMENTS

The electrophotographic photosensitive member according to the present invention does not undergo the dielectric breakdown due to the corona charging, but forms very clear reproduction image. In case the electrophotographic photosensitive member is subjected to the electrophotographic processes to form an image at the initial stage, followed by subsequent formation of other imgage, a part of the electrostatic charge corresponding to the initially formed image remains at the time of the subsequent image formation. This phenomenon is called the "memory phenomenon." As this memory phenomenon becomes intense, there emerges a ghost image. The electrophotographic photosensitive member according to the present invention is less in such memory phenomenon, hence no ghost image appears. Further, since the electrophotographic photosensitive member of the present invention is difficult to be affected by moisture, its charge sustaining capability is satifactory and a stable image formation can be realized. Furthermore, the electrophotogaphic photosensitive member according to the present invention is excellent in its tonality of the reproduced image, and also exhibits effective reproducibility of an image in an intermediate tone. It has also good toner transfer efficiency to thereby be able to form an image of high image contrast. In addition, the photoconductive layer of the electrophotographic photosensitive member according to the present invention is excellent in its mechanical strength, heat-resistance, solvent-resistance, hardness, and adhesivity to the substrate, which contribute to improvement in the durability of the photosensitive member. Further, since the photoconductive layer of the electrophotographic photosensitive member of the present invention is excellent in its heat-resistance as mentioned above, it is possible to render the insulative layer provided on the photoconductive layer by a film forming method to be more durable by heat-setting. Such solvent-resistance and heat-resistance of the photoconductive layer are particularly effective in manufacturing a seamless drum-shaped photosensitive member. In the formation of the photoconductive layer, the other kind of resin material may be used, depending on necessity, together with the curable rubber.

The curable rubber to be used in the present invention is such one that produces bridge-connection, or cross-linking, by imparting thereto an energy such as heat, light, electron beam, etc. so as to change the same to that having a three-dimensional chemical structure with reduced rubber elasticity, and hardened becomes. The curable rubber forms the photoconductive layer in its cured state. In the case of using a cyclized rubber, however, the photoconductive layer can be effectively formed in its uncured state. For the curable rubber used in the present invention, various sorts of curable rubber available in general market can be used. Representative examples of such curable rubber are: cyclized butadiene rubber, isoprene rubber, isobutylene-isoprene rubber, butyl rubber, butadiene rubber, butadiene-styrene rubber, nitrile rubber, chloroprene rubber, chlorinated polyethylene rubber, fluorinated rubber, chloro-sulfonated polyethylene rubber, silicone rubber, and others. In particular, the cyclized rubber is excellent as the curable rubber. The cyclized rubber has within its molecule the cycle structure, examples of which are cyclized butadiene rubber, cyclized isoprene rubber, cyclized natural rubber, triazine rubber, and so on.

Besides the photosensitive member is manufactured by forming the photoconductive layer directly on the substrate, it may be fabricated by first forming a curable rubber layer on the substrate, on which rubber layer the photoconductive layer is subsequently formed. It may also be fabricated in such a manner that the curable rubber layer is formed on the photoconductive layer, on which rubber layer the substrate is provided.

Thickness of the curable rubber layer may be properly determined. Usually, it is from 0.1 to 10 microns, or more preferably from 0.1 to 5 microns. The content of the curable rubber to form the photoconductive layer ranges from 0.5 to 50 parts by weight with respect to 100 parts by weight of the photoconductive material, or more preferably, from 10 to 30 parts by weight.

For the photoconductive material, there may be used arbitrarily inorganic materials such as ZnO, CdS, $TiO_2$, CdSe, Se, SeTe, SeAs, etc., and organic materials such as phthalocyanine, polyvinyl carbazole, anthracene, polyvinyl pyrene, polyvinyl anthracene, etc.

As to the photosensitive member having the insulative layer, there may be appropriately used various kinds of resin materials to form such insulative layer. Examples of these resin materials are: organic insulative substances such as polyethylene, polyester, polypropylene, polystyrene, polyvinyl chloride, polyvinyl acetate, acrylic resin, polycarbonate, silicone resin, fluorinated resin, epoxy resin, urethane resin, melamine resin, and so on.

For more readily forming the insulative layer, coating of such insulative layer is more excellent than its adhesion to the photoconductive layer. The coating method is effective in forming a seamless insulative layer on the drum-shaped photosensitive member. From such standpoint, use of a curable resin is more effective than the use of other kind of resins.

For the particularly appropriate curable resin, there can be enumerated acrylic resin, urethane resin, polyester resin, epoxy resin, melamine resin, silicone resin, and so on. Thickness of the insulative layer is usually set in a range of from 0.1 to 100 microns, and more preferably from 0.1 to 50 microns. It is also possible that, at the time of forming the photoconductive layer, such layer is formed by the coating method so that no granular photoconductive material remain on the surface of the formed photoconductive layer, whereby the surface part thereof may be rendered the insulative layer.

The substrate may be formed from any appropriate material such as stainless steel, copper, alumimum, tin, and other metal plates, as well as paper, sheet, resin film, and other sheet material. The substrate may be dispensed with as the case may be.

Thickness of the photoconductive layer, though depending on the kind and characteristics of the photoconductive substance to be used, may generally range from 5 to 100 microns, and more preferably from 10 to 50 microns or so.

In order to enable those skilled persons in the art to understand fully the present invention, the following examples are presented. It should however be noted that the present invention is not limited to these examples alone.

EXAMPLE 1

15 parts by weight of curable cyclized butadiene rubber (produced and sold by Japan Synthetic Rubber Co., Ltd. under a trade name "CBR") as the binder and 1 part by weight of diazo curing agent were added to and well mixed with 100 parts by weight of CdS powder. The mixture was passed for five times through a roll mill device having a gap of 40 microns for perfect mixing of the CdS powder and the binder. Thereafter, viscosity of the mixture was adjusted to 800 cps by the use of methylethyl ketone. Then, a cylindrical substrate made of aluminum was immersed in this viscosity-adjusted liquid and drawn up at a speed of 30 mm/min., after which this cylindrical substrate was heat-treated for 30 minutes at 150° C. to cure the liquid coating, thereby forming the photoconductive layer of 50 microns in thickness. The thus formed photoconductive layer was found to be insoluble in ketone solvents and to have a heat-resistance of about 200° C. It was also found out that hardness of the binder was higher than "3H" in pencil hardness (determined in accordance with Japanese Industrial Standard (JIS) No. K-5401), and its adhesivity to the substrate was satisfactory.

The obtained photoconductive layer was immersed in a diluted liquid of photo-curing type acryl urethane resin (manufactured and sold by Kansai Paint Co., Ltd. under a trade name of "SONNE"), the viscosity of which was so adjusted by methylethyl ketone solvent as to become 90 cps, and drawn up at a speed of 30 mm/min. After this, the photoconductive layer was subjected to light irradiation by a 4 kw mercury lamp for 5 minutes to cure the resin, thereby forming the insulative layer of 10 microns thick. The above-mentioned operation was repeated for three times to form the insulative layer of 30 microns thick on the photoconductive layer. It was observed at the time of forming the insualative layer that no pentration of the insulative-layer-forming-resin into the photoconductive layer, hence no deterioration in the characteristics of the photoconductive layer.

The thus obtained photosensitive member was subjected to the electrophotographic processes consisting of the primary d.c. positive corona charging, the secondary a.c. corona discharging simultaneous with image exposure, the overall surface exposure, the wet-type image development with negative toner, the image transfer to an image transfer medium, and the cleaning by a blade, after which it was examined for its dielectric breakdown resistance, moisture resistance, memory phenomenon, tonality, and durability.

The dielectric breakdown was examined by measuring white dots to occur in the image formed on the image transfer medium where no toner adheres when the photosensitive member undergoes the dielectric breakdown. The measurement of the white dot members was conducted after the electrophotographic processes had been repeated for 1,000 times. The memory phenomenon was examined by measuring the residual potential of the image formed by the first electrophotographic processes and that of the image formed by the subsequent second electrophotographic processes, in which the "image exposure" in the secondary a.c. corona discharging simultaneous with image exposure was changed to the "overall surface exposure." The moisture resistance was examined by measuring the contrast potential of the electrostatic image to be formed when the electrophotographic processes were conducted at 25° C. and 60% RH (Relative Humidity) and that of the electrostatic image to be formed when the electrophotographic processes were conducted after the photosensitive member had been left in the atmosphere at 35° C. and 85% RH for 24 hours. The tonality was examined by measuring the distinguishable number of step-wedges in 10 stages used as the original, when they are reproduced. The durability of the photosensitive member was examined by measuring the number of revolution of the drum-shaped photosensitive member until a part of the insulative layer or the photoconductive layer thereof was exfoliated as the result of the repeated electrophotographic processes.

For the sake of comparison, the same measurements as mentioned above were conducted on the photosensitive members using, in place of the curable cyclized buadiene rubber as the binder for the photoconductive layer, polyethylene, polypropylene, polyester, copolymer of vinyl chloride and vinyl acetate, polystyrene, acrylic resin, and epoxy resin. The results are as shown in the following Table 1.

TABLE 1

| Binder | Number of White Dots per 1500 cm$^2$ | Residual Potential | Humidity Resistance 60% | Humidity Resistance 85% | Tonality | Durability |
|---|---|---|---|---|---|---|
| Curable Cyclized Butadiene Rubber | 0 | 3 V | 650V | 630V | 10 | 50,000 or above |
| Polyethylene | 10 | 20 V | 670V | 630V | 7 | 2,000 |
| Polypropylene | 8 | 30 V | 640V | 570V | 7 | 2,500 |
| Solvent-soluble Polyester | 4 | 20 V | 650V | 600V | 7 | 20,000 |
| Copolymer of Vinyl Chloride and Vinyl Acetate | 3 | 10 V | 650V | 620V | 8 | 38,000 |
| Polystyrene | 10 | 40 V | 680V | 590V | 7 | 1,500 |
| Acrylic Resin | 7 | 40 V | 670V | 580V | 7 | 2,500 |
| Epoxy Resin | 6 | 50 V | 660V | 550V | 6 | 15,000 |

From the above Table 1, it is recognized that the photosensitive member according to the present invention is very excellent in all of its properties.

Also, in the present embodiment, the results of measurements on the photosensitive member having the photoconductive layer formed with curable cyclized butadiene rubber which was not yet cured were as follows: number of white dot . . . 2, ewsidual potential . . . 10 V; moisture resistance . . . 660 V (60%) and 600 V (85%); tonality . . . 8; and durability . . . 20,000 and above. These results were also excellent.

EXAMPLE 2

In substitution for the curable cyclized butadiene rubber (trade name "CBR") used in Example 1 above, the following curable cyclized rubbers A through E were used to form the photosensitive members, and the measurements were conducted in the exactly same manner as in Example 1, the results of which were found to be also excellent. Even when these curable cyclized rubbers were used for forming the photosensitive members without curing treatment, their durability, dielectric breakdown resistance, tonality, moisture resistance, etc. were found to have been improved.

A. Curable cyclized rubber (manufactured and sold by Japan Synthetic Rubber Co., Ltd. under a trade name "CLBR") —curing conditions: 180° C. for 20 mins.

B. Curable cyclized isoprene rubber (manufactured and sold by Eastman Kodak under a trade name of "Kodak Thin Film Resist KTFR")—curing conditions: light irradiation for 5 mins. by a high pressure mercury lamp.

C. Curable cyclized polyisoprene rubber (manufactured and sold by Tokyo Ohka Kogyo Co., Ltd. under a trade name of "OMR")—curing conditions: 150° C. for 30 mins.

D. Curable cyclized natural rubber (manufactured and sold by Fuji Chemicals Industrial Co., Ltd. under a trade name of "Fuji Super Resist FSR")—curing conditions: 180° for 20 mins.

E. Curable cyclized natural rubber (manufactured and sold by Hoechst Co., Ltd. under a trade name of "ALPEX CK450")—curing conditions: 160° C. for 30 minutes.

EXAMPLES 3 to 9

The dielectric breakdown resistance, memory phenomenon, moisture resistance, tonality, and durability of the photosensitive members manufactured by use of the undermentioned resine Ex. 3 to 9 in place of the cyclized butadiene rubber (for the photoconductive layer) and the photocuring type acryl urethane resin (for the insulative layer) in Example 1 were examined. The results were favorable. The numerical figures for the temperature and time in the parenthesis indicate the curing conditions of the curable rubber.

(EXAMPLE 3)

Photoconductive layer: Curable polyisoprene rubber (manufactured and sold by Kureha Chemical Industries Co., Ltd. under a trade name of "KURARAY") (160° C., 40 mins.)

Insulative layer: Photo-curing type acrylic resin (manufactured and sold by Toa Gosei Chemical Industry Co., Ltd. under a trade name of "ARONIX")

(EXAMPLE 4)

Photoconductive layer: Curable polynitrile-butadiene rubber (manufactured and sold by Mitsui Toatsu Chemicals, Inc. under a trade name of "POLYLUCK") (150° C., 30 mins.)

Insulative layer: Photo-curing type polyester resin (manufactured and sold by Nippon Polyurethane Industry Co., Ltd. under a trade name of "DESMOPHENE")

(EXAMPLE 5)

Photoconductive layer: 80 % of curable silicone rubber (manufactured and sold by Toray Silicone Co., Ltd. under a trade name of "SH432") and 20% of epoxy resin (manufactured and sold by Shell Chemical Co., Ltd. under a trade name of "EPIKOTE") (170° C., 30 mins.)

Insulative layer: Thermo-setting melamine resin (manufactured and sold by Nippon Soda Co., Ltd. under a trade name of "SUPER BECKAMINE 5-820")

(EXAMPLE 6)

Photoconductive layer:

Curable acryl rubber (manufactured and sold by Nippon Zeon Co., Ltd. under a trade name of "HYCAR 4021") (160° C., 20 mins.)

Insulative layer: Thermo-setting epoxy-modified silicone resin (manufactured and sold by Shinetsu Kogaku Co., Ltd. under a trade name of "ES1002-T")

(EXAMPLE 7)

Photoconductive layer: 90% of curable ethylene-propylene rubber (manufactured and sold by Sumitomo Chemicals Co., Ltd. under a trade name of "ESPRENE-EPPM") and 10% of polyester (manufactured and sold by Toyobo Co., Ltd. under a trade name of "VYLON 200") (160° C., 20 mins.)

Insulative layer: Photo-curing type acryl resin (manufactured and sold by Tokyo Ohka Kogyo Co., Ltd. under a trade name of "PHOTOFIX")

(EXAMPLE 8)

Photoconductive layer:: Curable ethylene-propylene rubber (manufactured and sold by Sumitomo Chemicals Co., Ltd. under a trade name of "ESPRENE-EPPM") (140° C., 40 mins.)

Insulative layer: Thermo-setting epoxy-modified silicone resin (manufactured and sold by Shinetsu Kogaku Co., Ltd. under a trade name of "ES1001")

(EXAMPLE 9)

Photoconductive layer: Curable Polysulfide rubber (manufactured and sold by Toray Thiokol Co., Ltd. under a trade name of "THIOKOL") (150° C., 30 mins.)

Insulative layer: Thermo-setting urethane-modified silicon resin (manufactured and sold by Shinetsu Kogaku Co., Ltd. under a trade name of "KR302)

EXAMPLE 10

The photosensitive member having no insulative layer provided thereon was subjected to the electrophotographic processes comprising primary d.c. negative charging to render its surface potential to be 700 V, image exposure, latent image formation, wet-type image development with positive toner, image transfer to an image transfer paper, and cleaning by a blade, after which it was examined for various properties such as the dielectric breakdown resistance, memory phenomenon, moisture resistance, tonality, durability, charge sustaining capability, and toner transfer ratio in the same manner as in Example 1.

The charge sustaining capability was examined by measuring the surface potential of the photosensitive member after 10 seconds' lapse from its charging with 700 V. The toner transfer ratio was examined by measuring the ratio of transfer of the total toner adhered onto the photosensitive member, when the toner image formed on the photosensitive member was electrostatically transferred to the image transfer paper. The results are as shown in the following Table 2. From the results, the photosensitive member is found to be very excellent in the above properties.

TABLE 2

| Binder | Number of White Dots per 1500 cm$^2$ | Residual Potential | Humidity Resistance 60% | Humidity Resistance 85% | Tonality | Durability | Charge Sustaining Capability | Toner Transfer Ratio |
|---|---|---|---|---|---|---|---|---|
| Curable Cyclized Butadiene Rubber | 0 | 3 V | 670V | 650V | 10 | 50,000 or above | 690V | 90% |
| Polyethylene | 9 | 20 V | 630V | 570V | 7 | 2,500 | 670V | 85% |
| Polypropylene | 8 | 30 V | 640V | 580V | 7 | 3,000 | 630V | 85% |
| Solvent-Soluble Polyester | 5 | 25 V | 650V | 600V | 8 | 10,000 | 680V | 85% |
| Copolymer of Vinyl Chloride and Vinyl Acetate | 2 | 10 V | 640V | 610V | 8 | 15,000 | 650V | 85% |
| Polystyrene | 10 | 40 V | 640V | 560V | 7 | 2,000 | 590V | 75% |
| Acrylic Resin | 8 | 40 V | 640V | 550V | 7 | 2,500 | 600V | 60% |
| Epoxy Resin | 7 | 50 V | 650V | 540V | 6 | 15,000 | 610V | 60% |
| Urethane Resin | 7 | 40 V | 650V | 570V | 6 | 3,500 | 620V | 65% |
| Polyvinylidene Fluoride | 8 | 30 V | 640V | 480V | 7 | 3,000 | 620V | 80% |

What is claimed is:

1. In an electrophotographic photosensitive member having a coated photoconductive layer comprising a photoconductive material dispersed in a binder, the improvement which comprises a curable cyclized rubber selected from the group consisting of cyclized butadiene rubber and cyclized isoprene rubber as said binder and said curable cyclized rubber is cured after coating to form said photoconductive layer.

2. The electrophotographic photoconductive member according to claim 1 further including an insulating layer on said photoconductive layer.

* * * * *

UNITED STATES PATENT AND TRADEMARK OFFICE

CERTIFICATE OF CORRECTION

PATENT NO. : 4,395,474

DATED : July 26, 1983

INVENTOR(S) : HIDEYO KONDO, ET AL.

It is certified that error appears in the above-identified patent and that said Letters Patent is hereby corrected as shown below:

Col. 1, line 6, delete "division".
Col. 1, line 15, delete "a".
Col. 1, line 16, delete "or".
Col. 1, line 19, delete "such".
Col. 1, line 20, delete "such".
Col. 1, line 34, "pollutions" should be --pollution--.
Col. 1, line 67, after "that" insert --it--.
Col. 2, line 19, "other" should be --another--.
Col. 2, line 23, "other" should be --another--.
Col. 2, line 27, "characterised" should be --characterized--.
Col. 2, line 40, "other" should be --another--.
Col. 2, line 40, "imgage" should be --image--.
Col. 3, line 9, delete "such".
Col. 3, line 13, "hardened becomes" should be --becomes hardened--.
Col. 3, line 19, after "in" insert --the--.
Col. 3, line 31, "is" to --being--.
Col. 3, line 61, "more excellent" should be --better--.
Col. 4, line 32, delete "for".
Col. 4, line 62, "insualative" should be --insulative--.
Col. 4, line 63, after "photoconductive layer" insert --occured--.
Col. 5, line 9, "to occur" to --occurring--.
Col. 5, lines 12-13, "members" to --numbers--.

UNITED STATES PATENT AND TRADEMARK OFFICE

CERTIFICATE OF CORRECTION

PATENT NO. : 4,395,474

DATED : July 26, 1983

INVENTOR(S) : HIDEYO KONDO, ET AL.

It is certified that error appears in the above-identified patent and that said Letters Patent is hereby corrected as shown below:

Col. 5, line 34, "revolution" should be --resolutions--.
Col. 5, line 41, "buadiene" should be --butadiene--.
Col. 6, line 5, "dot" should be --dots--.
Col. 6, line 5, "ewsidual" should be --residual--.
Col. 6, line 39, after "180°" insert --C--.
Col. 6, line 49,"resine" should be --resins--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*